United States Patent [19]

Uchida et al.

[11] Patent Number: 4,971,587

[45] Date of Patent: Nov. 20, 1990

[54] APPARATUS FOR FIXING A COWLING OF AN OUTBOARD MOTOR

[75] Inventors: Tatsumi Uchida; Kunihiko Suzuki, both of Yokohama; Naoki Kato, Hamamatsu, all of Japan

[73] Assignees: NHK Morse Co., Ltd., Yokohama; Sanshin Industries Co., Ltd., Shizuoka, both of Japan

[21] Appl. No.: 436,294

[22] Filed: Nov. 13, 1989

[30] Foreign Application Priority Data

Nov. 22, 1988 [JP] Japan ..... 63-295429

[51] Int. Cl.[5] ..... B63H 21/26

[52] U.S. Cl. ..... 440/77; 292/128; 123/195 P

[58] Field of Search ..... 440/76, 77, 78; 123/198 P, 198 E, 195 P; 292/95, 96, 100, 101, 130

[56] References Cited

U.S. PATENT DOCUMENTS

| | | | |
|---|---|---|---|
| 4,800,854 | 1/1989 | Boda et al. | 440/77 |
| 4,871,333 | 10/1989 | Curtis et al. | 440/77 |
| 4,875,883 | 10/1989 | Slattery | 440/77 |
| 4,927,194 | 5/1990 | Wagner | 440/77 |

FOREIGN PATENT DOCUMENTS 59-54400 4/1984 Japan .

*Primary Examiner*—Sherman Basinger
*Assistant Examiner*—Jesûs D. Sotelo
*Attorney, Agent, or Firm*—Frishauf, Holtz, Goodman & Woodward

[57] ABSTRACT

In an apparatus for fixing a cowling assembly of an outboard motor, a base member is provided with a locking plate and an intermediate plate. The locking plate has a jaw portion and a stay-receiving face for clamping a stay when the cowling assembly is locked. The intermediate plate has a first stopper portion, a second stopper portion and a cam-receiving portion, In the locked state of the cowling assembly, the first stopper portion is engaged with the locking plate. In the released state of the cowling assembly, the second stopper is engaged with the locking plate. The intermediate plate is moved in a direction to release the cowling assembly, by means of an operation lever arranged at a front portion of a bottom cowling. A spring interposed, in its compressed form, between a spring seat of the locking plate and a spring seat of the intermediate plate urges the locking plate and the intermediate plate to rotate in such a direction as to engage the locking plate with the stopper portions. The operating lever is connected to an intermediate plate of a rear locking mechanism.

4 Claims, 8 Drawing Sheets

APPARATUS FOR FIXING A COWLING OF AN OUTBOARD MOTOR

BACKGROUND OF THE INVENTION

1. Field of the Invention

The present invention relates generally to an apparatus for fixing a top cowling of an outboard motor to a bottom cowling thereof, and more particularly to a structure of a locking mechanism used in this apparatus.

2. Description of the Related Art

A power unit of an outboard motor is covered by a cowling assembly. The cowling assembly includes a bottom cowling and a top cowling mounted on the bottom cowling. It is necessary that the top cowling be removable from the bottom cowling. The top cowling is fixed to the bottom cowling by a locking mechanism.

The locking mechanism comprises a stay provided on one of the bottom cowling and the top cowling, and a locking plate provided on the other of the cowlings. The locking mechanism is movable between a locked position where the stay is held, and a released position where the stay is released. The locking plate is operated by means of an operating lever.

In this type of the locking mechanism, the stay and the locking plate must be firmly engaged with each other for ensuring the fixing of the top cowling. However, as the degree of engagement between the stay and the locking plate increases, the operating lever must be moved by a greater stroke for releasing the stay from the locking plate, resulting in a troublesome releasing operation.

Once the locking mechanism is released, it is desirable for easy removal of the top cowling that the top cowling be lifted from the bottom cowling to some degree. However, in order to lift the top cowling, a spring must be provided, separately from the locking mechanism. This increases the number of parts and makes the structure of the apparatus complex.

A large-sized outboard motor is provided with two locking mechanisms at the front and rear parts of the top cowling, for ensuring the fixing of the top cowling. However, if operating levers for releasing the locking mechanisms are provided for the respective locking mechanisms, it is troublesome to handle the operation lever of the rear locking mechanism which is situated farther from the hull. In particular, the releasing operation conducted on the water is dangerous.

SUMMARY OF THE INVENTION

An object of the present invention is to provide a cowling fixing apparatus wherein a top cowling can be firmly fixed, and, when the top cowling is to be removed, a release operation for the locking mechanism can be performed easily and surely. Another object of the invention is to provide a cowling fixing apparatus wherein the top cowling can be lifted at the time of the release, by virtue of the force of a spring of a locking mechanism. Still another object of the invention is to provide a cowling fixing apparatus wherein both front locking mechanism and rear locking mechanism can be simultaneously released by operating a single lever.

According to the cowling fixing apparatus of the present invention, the top cowling can be firmly fixed in the locked mode. In the released mode, both front and rear locking mechanisms can be easily released by operating a single lever arranged at a front part of the cowling assembly. Also, in the released mode, the top cowling can be lifted from the bottom cowling by virtue of the force of a spring of the locking mechanism. This spring serves also as an actuator for instantaneously rotating the locking plate to the release position when the locking mechanism is released.

More specifically, the present invention provides an apparatus for fixing a top cowling and a bottom cowling to each other, which constitute a cowling assembly of an outboard motor, said apparatus comprising:

a stay secured to one of the top cowling and the bottom cowling;

a base member secured to the other of the top cowling and the bottom cowling and having a receiving section for receiving a portion of the stay;

a locking plate rotatably attached to the base member by means of a first shaft, said locking plate having a stay-receiving face extending in a direction crossing the receiving section, a jaw portion projecting toward the receiving section, a projection, and a spring seat, and said locking plate being rotatable between a locked position, in which the portion of the stay inserted in the receiving section of the base member is clamped between the stay-receiving face and the jaw portion, and a released position in which the jaw portion is retreated from the receiving section to allow the stay to move out of the receiving section;

an intermediate plate rotatably attached to the base member by means of a second shaft, and having a first stopper portion, a second stopper portion, a cam-receiving portion and a spring seat, said first stopper portion being arranged in such a position as to hold the locking plate in the locked position when the first stopper section is engaged with the projection of the locking plate, and said second stopper portion being arranged in such a position as to hold the locking plate in the released position when the second stopper portion is engaged with the projection of the locking plate;

a cam member rotatably arranged near the intermediate plate, the cam member pushing the cam-receiving portion of the intermediate plate when the cam member is rotated to a predetermined position, thereby rotating the intermediate plate in such a direction as to release the engagement between the projection of the locking plate and the first stopper portion;

an operating lever arranged at a front portion of the cowling assembly, for rotating the cam member; and a spring interposed, in its compressed form, between the spring seat of the locking plate and the spring seat of the intermediate plate, the spring urging the locking plate and the intermediate plate to rotate in such a direction as to engage the projection of the locking plate with the stopper portions of the intermediate plate.

In the case where locking mechanisms are provided at both the front and rear parts of the cowling assembly, a member cooperating with the operating lever and an intermediate plate of the rear locking mechanism are connected to each other by a cable.

DESCRIPTION OF THE PREFERRED EMBODIMENTS

Preferred embodiments of the present invention will now be described with reference to the accompanying drawings.

Figure 1:
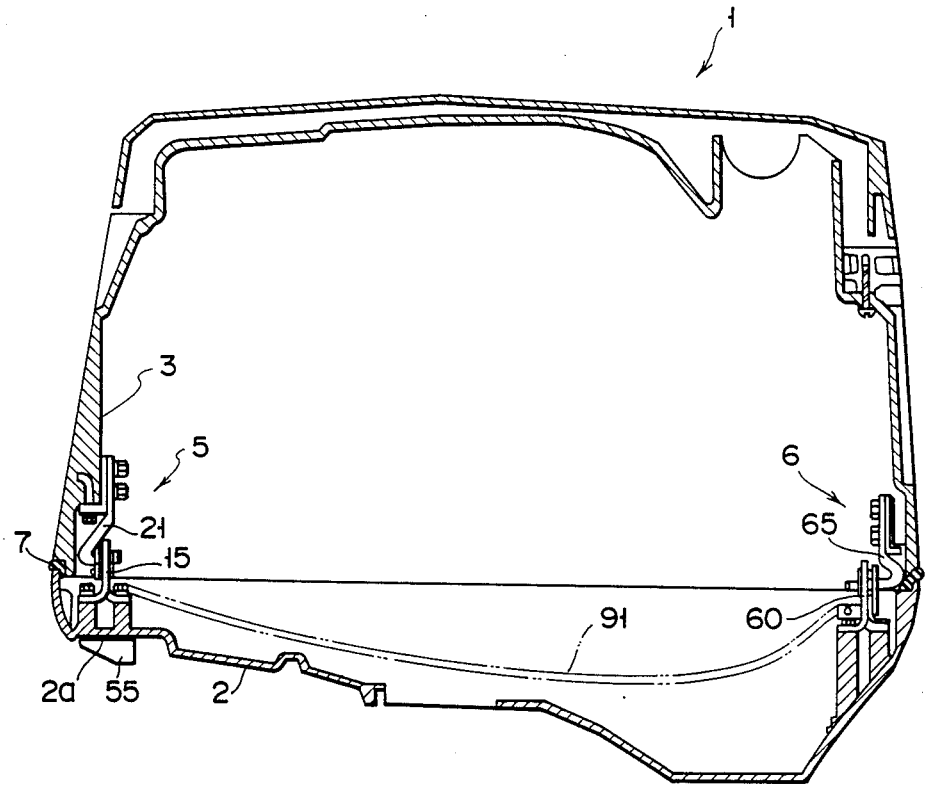
FIG. 1 is a vertical cross-sectional view of a cowling assembly having locking mechanisms according to a first embodiment of the present invention.
Figure 2:
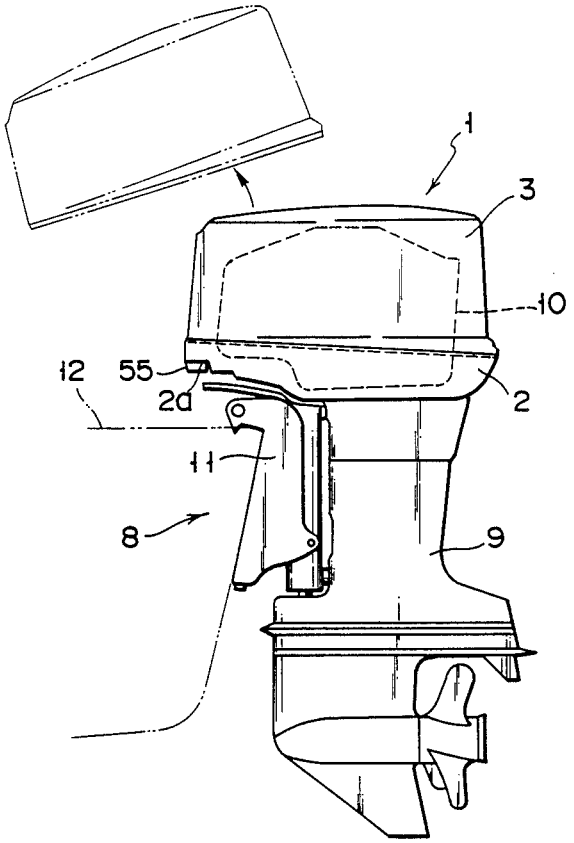
FIG. 2 is a side view of an outboard motor having the cowling assembly shown in FIG. 1.

In FIGS. 1 and 2, a cowling assembly 1 for an outboard motor comprises a bottom cowling 2 and a top cowling 3. The top cowling 3 is removably attached to the bottom cowling 2 such that the top cowling 3 is removed from the bottom cowling 2 by means of a cowling fixing apparatus including a front locking mechanism 5 and a rear locking mechanism 6. A waterproof packing 7 is provided along the entire connection areas of the bottom cowling 2 and the top cowling 3. In an outboard motor 8, a casing 9 is arranged below the bottom cowling 2. A conventional power unit 10 and a power transmission system are contained within the cowling assembly 1 and the casing 9. The outboard motor 8 is secured to a hull 12 by means of a bracket 11.

Figure 3:
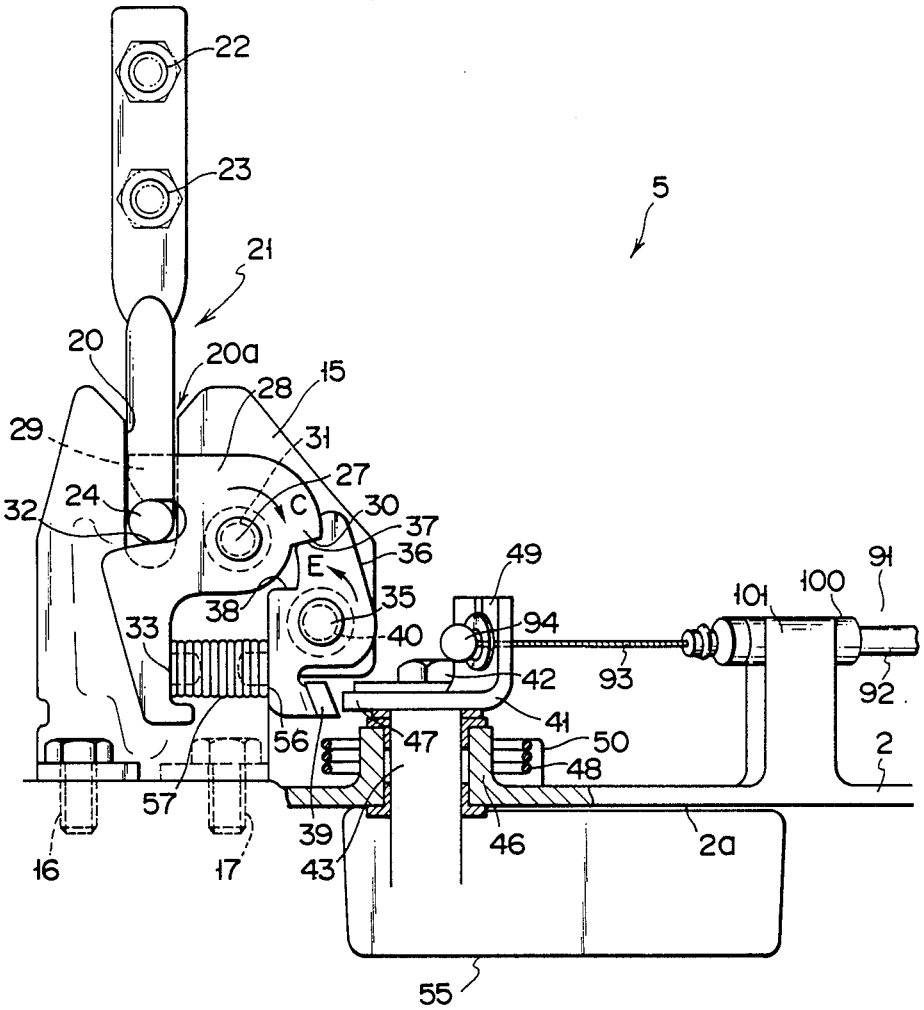
FIG. 3 is a side view of a front locking mechanism shown in FIG. 1.
Figure 4:
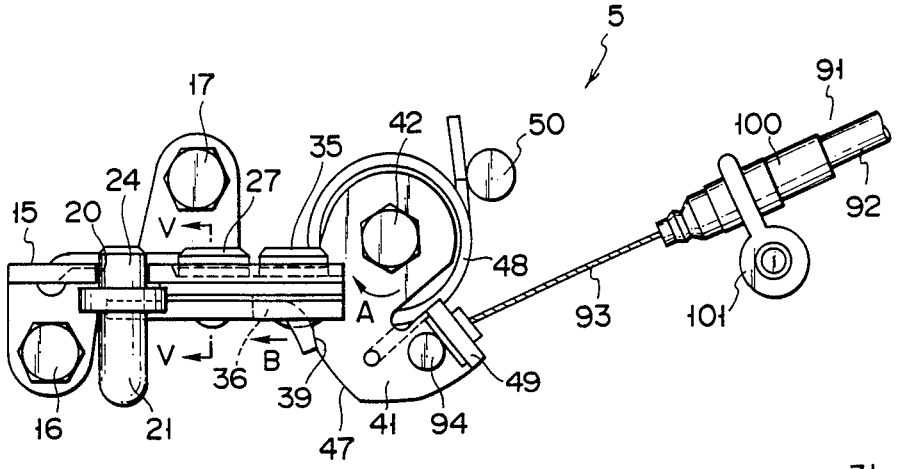
FIG. 4 is a plan view of the front locking mechanism shown in FIG. 1.
Figure 5:
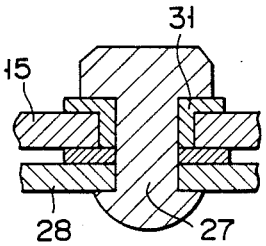
FIG. 5 is a cross-sectional view taken along line V—V in FIG. 4.
Figure 6:
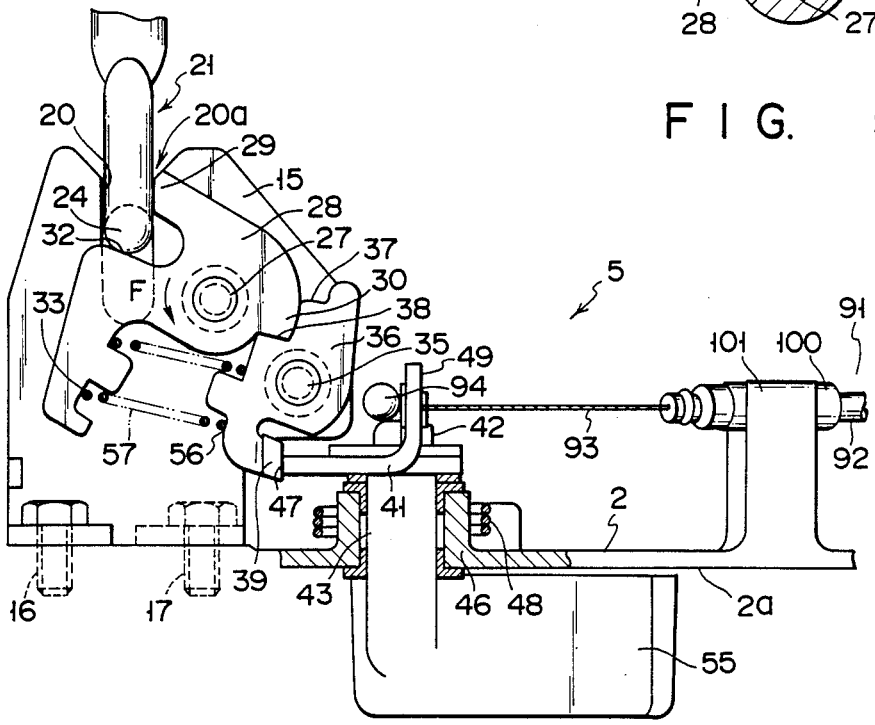
FIG. 6 is a side view of the front locking mechanism shown in FIG. 1, wherein the front locking mechanism is released.
Figure 7:
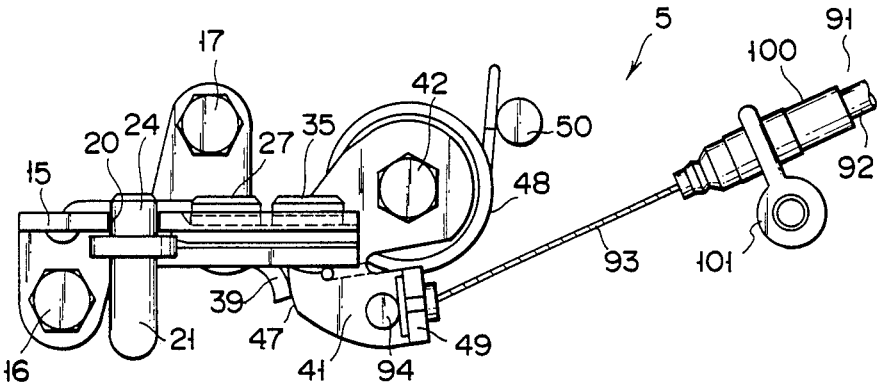
FIG. 7 is a plan view of the front locking mechanism shown in FIG. 1, wherein the front locking mechanism is released.

FIGS. 3 to 7 show the front locking mechanism 5 in greater detail. FIGS. 3 and 4 show the locked state of the front locking mechanism 5, and FIGS. 6 and 7 show the released state of the same.

A structure of the front locking mechanism 5 will now be described. A base member 15 is fixed to the bottom cowling 2 by means of bolts 16 and 17. The base member 15 is formed by subjecting a metal plate to press processing. A vertically extending receiving section 20 having an opening 20*a* is formed in an upper portion of the base member 15.

A stay 21 is formed of a metal rod having a predetermined shape. The stay 21 is secured to the top cowling 3 by means of bolts 22 and 23, in a position corresponding to the base member 15. A lower portion of the stay 21 is provided with an L-shaped hook portion 24. The hook portion 24 is allowed to enter the receiving section 20 through the opening 20*a*.

A locking plate 28 is rotatably attached to a horizontally extending first shaft 27 provided in the base member 15. A jaw portion 29 is provided on one side of a locking plate 28. The jaw portion 29 projects into the receiving section 20. A projection 30 is provided on the other side of the locking plate 28. The projection 30 projects in a direction opposite to the direction in which the jaw portion 29 projects. The locking plate 28 is rotatable about the first shaft 27 between the locked position shown in FIG. 3 and the released position shown in FIG. 6. The first shaft 27 rotates along with the plate 28. As shown in FIG. 5, a low-friction bush 31 for smooth rotation is interposed between the first shaft 27 and the base member 15. The locking plate 28 has a stay-receiving face 32 and a spring seat 33. The stay-receiving face 32 crosses the receiving section 20.

The base member 15 is provided with a second shaft 35 extending in parallel to the first shaft 27. An intermediate plate 36 is rotatably mounted on the second shaft 35. The intermediate plate 36 has a first stopper portion 37, a second stopper portion 38, and a cam receiving portion 39. The first stopper portion 37 serves to keep the locking plate 28 in its locked position. The second stopper portion 38 serves to keep the locking plate 28 in its released position. The cam receiving portion 39 is substantially opposed to the first stopper portion 37 with respect to the second shaft 35. A low-friction bush 40 is provided on the second shaft 35 for smooth rotation of the intermediate plate 36.

A cam member 41 is arranged near the intermediate plate 36. The cam member 41 is fixed on a shaft 43 by means of a bolt 42. The shaft 43 is rotatably supported in a bearing section 46 mounted on the bottom cowling 2. The axis of the bearing section 46 extends in the vertical direction. The cam member 41 rotates over a range between the locked position shown in FIG. 4 and the release position shown in FIG. 7. All of cam member 41, intermediate plate 36 and locking plate 28 are formed by subjecting metal plates to press processing.

When the cam member 41 is rotated to the release position, a cam surface 47 provided on one side of the cam member 41 pushes the cam receiving portion 39. Consequently, the engagement between the first stopper portion 37 and the projection 30 is released. The cam member 41 is constantly urged to return to the locked position shown in FIG. 4 by the force of a torsion spring 48. A cable connecting section 49 is provided near the cam surface 47. A pin 50 for supporting an end portion of the spring 48 is arranged near the bearing section 46.

An operating lever 55 having the shaft 43 is rotatably supported by the bearing section 46. The lever 55 and the cam member 41 rotates as one body. The lever 55 is located on a lower surface 2*a* of a front part of the bottom cowling 2, that is, within reach of the hand of a person on the hull 12.

A coil spring 57 is, in its compressed state, arranged between the spring seat 33 of the locking plate 28 and a spring seat 56 of the intermediate plate 36. The force of the spring 57 urges the locking plate 28 in the direction of arrow C (clockwise direction) in FIG. 3, and simultaneously urges the intermediate plate 36 in the direction of arrow E (anticlockwise direction).

Figure 8:
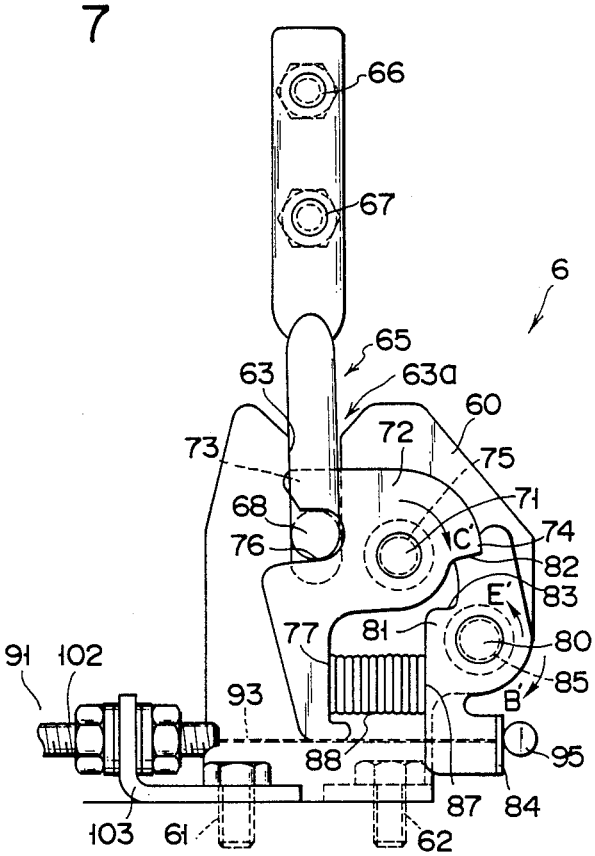
FIG. 8 is a side view of a rear locking mechanism shown in FIG. 1.
Figure 9:
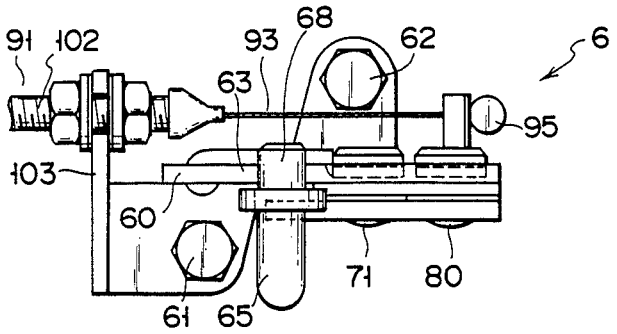
FIG. 9 is a plan view of the rear locking mechanism shown in FIG. 8.
Figure 10:
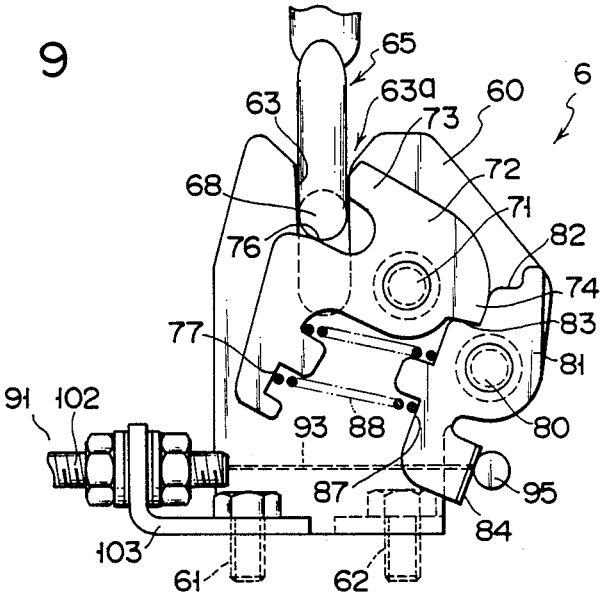
FIG. 10 is a side view of the rear locking mechanism shown in FIG. 1, wherein the rear locking mechanism is released.
Figure 11:
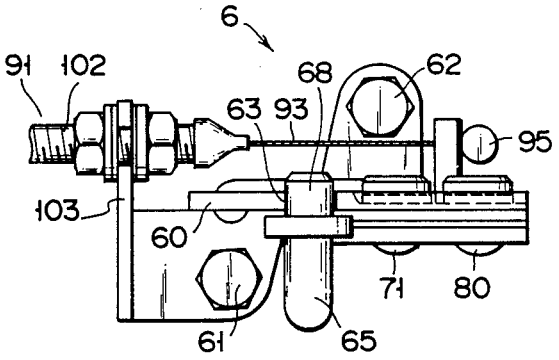
FIG. 11 is a plan view of the rear locking mechanism shown in FIG. 1, wherein the rear locking mechanism is released.

The rear locking mechanism 6 will now be described with reference to FIGS. 8 to 11. FIGS. 8 and 9 show the locked state of the locking mechanism 6, and FIGS. 10 and 11 show the released state thereof.

A base member 60 has substantially the same shape as the front base member 15, described above. The base member 60 is fixed to the bottom cowling 2 by means of bolts 61 and 62. A vertically extending receiving section 63 having an opening 63*a* is formed in an upper portion of the base member 60.

The structure of a stay 65 is the same as that of the front stay 21. The stay 65 is secured to the top cowling 3 by means of bolts 66 and 67, in a position corresponding to the base member 60. A hook portion 68 is provided at a lower portion of the stay 65. The hook portion 68 is allowed to enter the receiving section 63 through the opening 63*a*. Both stays 21 and 65 are not projected from the bottom surface of the top cowling 3.

A locking plate 72 is rotatably attached to a horizontally extending third shaft 71 provided in the base member 60. A jaw portion 73 is provided on one side of a locking plate 72. The jaw portion 73 projects into the receiving section 63. A projection 74 is provided on the other side of the locking plate 72. The projection 74 projects in a direction opposite to the direction in which the jaw portion 73 projects. The locking plate 72 is rotatable about the third shaft 71 between the locked position shown in FIG. 8 and the released position shown in FIG. 10. A low-friction bush 71 is mounted on the third shaft 71. The locking plate 72 has a stay-receiving face 76 and a spring seat 77. The stay-receiving face 76 crosses the receiving section 63.

The base member 60 is provided with a fourth shaft 80 extending in parallel to the third shaft 71. An intermediate plate 81 is rotatably mounted on the fourth shaft 80. The intermediate plate 81 has a third stopper portion 82, a fourth stopper portion 83, and a cable connecting section 84. The third stopper portion 82 serves to keep the locking plate 72 in its locked position. The fourth stopper portion 83 serves to keep the locking plate 72 in its released position. The cable connecting section 84 is substantially opposed to the third stopper portion 82 with respect to the fourth shaft 80. A low-friction bush 85 is provided on the fourth shaft 80.

A coil spring 88 is, in its compressed state, arranged between a spring seat 77 of the locking plate 72 and a spring seat 87 of the intermediate plate 81. The force of the spring 88 urges the locking plate 72 in a direction of arrow C′ (clockwise direction) in FIG. 8, and also urges the intermediate plate 81 in a direction of arrow E′ (anticlockwise direction).

The front locking mechanism 5 and the rear locking mechanism 6 are connected by a cable 91. The cable 91 comprises an outer tube 92 and an inner cable 93 inserted into the tube 92. Stoppers 94 and 95 are attached to both end portions of the inner cable 93. One of the stoppers 94 is connected to the cable connecting section 49 of the cam member 41 of the front locking mechanism 5, and the other stopper 95 is connected to the cable connecting section 84 of the intermediate plate 81 of the rear locking mechanism 6. One end portion 100 of the outer tube 92 is fixed by a cable fixing member 101 formed on the bottom cowling 2. The other end portion 102 of the outer tube 92 is fixed to a cable fixing section 103 attached to the base member 60 of the rear locking mechanism 6.

The operation of the cowling fixing apparatus having the locking mechanisms 5 and 6 will now be described.

In the locked state of the locking mechanism 5 (6) shown in FIG. 3 (FIG. 8), the hook portion 24 (68) of the stay inserted in the receiving section 20 (63) of the base member 15 (60) is supported by the jaw portion 29 (73).

When the lever 55 is rotated to release the locking mechanisms, the cam member 41 of the front locking mechanism 5 rotates in a direction of arrow A in FIG. 4. In accordance with the rotation of the cam member 41 in the direction of arrow A, the cam-receiving portion 39 is moved by the cam member 41 in a direction of arrow B, whereby the engagement between the projection 30 and the first stopper 37 is released. The moment this engagement is released, the locking plate 28 instantaneously rotates clockwise (direction of arrow C) by virtue of the force of the spring 57. The rotation of the locking plate 28 stops when the projection 30 abuts on the second stopper 38. Thus, the front locking mechanism 5 is set in the released state shown in FIG. 6. When the locking mechanism 5 is set in the released state, the jaw portion 29 of the locking plate 28 retreats from the receiving section 20. As a result, the hook portion 24 of the stay 21 is allowed to move upward and out of the opening 20*a* of the receiving section 20. In addition, in the released state, the locking plate 28 is rotated by the force of the spring 57 to the position shown in FIG. 6, so that the stay 21 may be pushed upward.

On the other hand, when the lever 55 is rotated to release the locking mechanisms, the cam member 41 is rotated to pull the inner cable 93. Consequently, the intermediate plate 81 of the rear locking mechanism 6 rotates in a direction of arrow B′ in FIG. 8. By the rotation of the intermediate plate 81 in the direction of arrow B′, the engagement between the projection 74 of the locking plate 72 and the third stopper portion 82 is released. The moment this engagement is released, the locking plate 72 instantaneously rotates in a direction of arrow C′ by virtue of the force of the spring 88. The rotation of the locking plate 72 stops when the projection 74 abuts on the fourth stopper portion 83, and the rear locking mechanism 6 is set in the released state shown in FIG. 10. In this released state, the jaw portion 73 of the locking plate 72 retreats from the receiving section 63, so as to allow the hook portion 68 of the stay 65 to move upward and out of the opening 63*a* of the receiving section 63. Also, in this released state, the locking plate 72 is rotated by the force of the spring 88 to the position illustrated in FIG. 10, and the stay 65 is pushed upward.

When the stays 21 and 65 are raised, as described above, the top cowling 3 is lifted from the bottom cowling 2, and the top cowling 3 can be easily removed. The springs 57 and 88 serve as actuators for instantaneously rotating the locking plates 28 and 72 to the released state, and also as actuators for lifting the top cowling 3 at the time of releasing the locking mechanisms.

When the removed top cowling 3 is fixed to the bottom cowling 2 once again, the top cowling 3 is placed on the bottom cowling 2 such that the stays 21 and 65 are loosely put in the openings 20*a* and 63*a* of the receiving sections 20 and 63, as shown in FIGS. 6 and 10. Then, the top cowling 3 is strongly depressed. In the front locking mechanism 5, the hook portion 24 of the stay 21 inserted in the receiving section 20 pushes down the stay-receiving face 32 of the locking plate 28. The locking plate 28 is rotated in a direction of arrow F (FIG. 6). Once the locking plate 28 is rotated until the projection 30 passes over the first stopper portion 37, the intermediate plate 36 is then rotated anticlockwise by virtue of the force of the spring 57. Thus, the projection 30 is engaged with the first stopper portion 37, and the locked state shown in FIG. 3 is restored. Regarding to the rear locking mechanism 6, the locking plate 72 and the intermediate plate 81 cooperate, as in the case of the front locking mechanism 5, and the locking plate 72 is restored to the locked state shown in FIG. 8.

As seen from the above description, the springs 57 and 88 serve also as actuators for restoring the intermediate plates 36 and 81 to their locked state.

Figure 12:
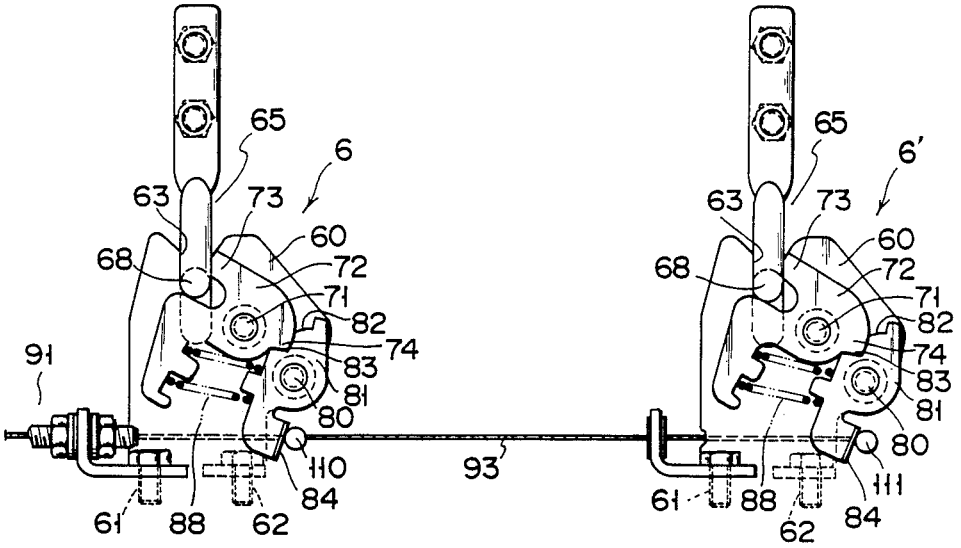
FIG. 12 is a side view showing an example wherein two rear locking mechanisms are provided.

In a second embodiment of the invention shown in FIG. 12, a pair of rear locking mechanisms 6 and 6' are connected in series by an extended portion 93 of the cable 91. An intermediate stopper 110 attached midway along the extended cable portion 93 is connected to the wire connecting section 84 of intermediate plate 81 of one of the pair of the rear locking mechanisms 6. On the other hand, a stopper 111 attached to the end portion of the extended cable portion 93 is connected to the wire connecting section 84 of intermediate plate 81 of the other rear locking mechanism 6'. The opposite-side end portion of cable 91 is connected to the cable connecting section 49 of cam member 41 of the front locking mechanism 5 of the first embodiment. Thus, when the lever 55 is moved in the direction for releasing the locking mechanisms, the intermediate plate 36 of the front locking mechanism 5 and the intermediate plates 81 of the rear locking mechanisms 6 and 6' rotate simultaneously to release the locking mechanisms.

Figure 13:
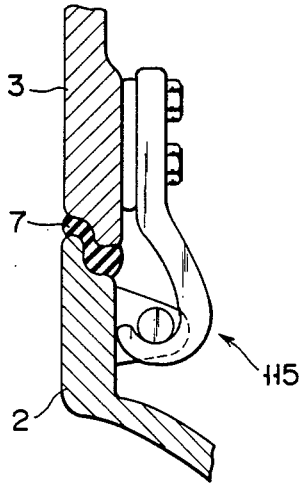
FIG. 13 is a vertical cross-sectional view showing an example wherein a rear part of the top cowling is supported by a hinge mechanism.

Rear parts of the bottom and top cowlings 2 and 3 may be coupled by means of a hinge mechanism 115 of a simple structure as shown in FIG. 13.

Figure 14:
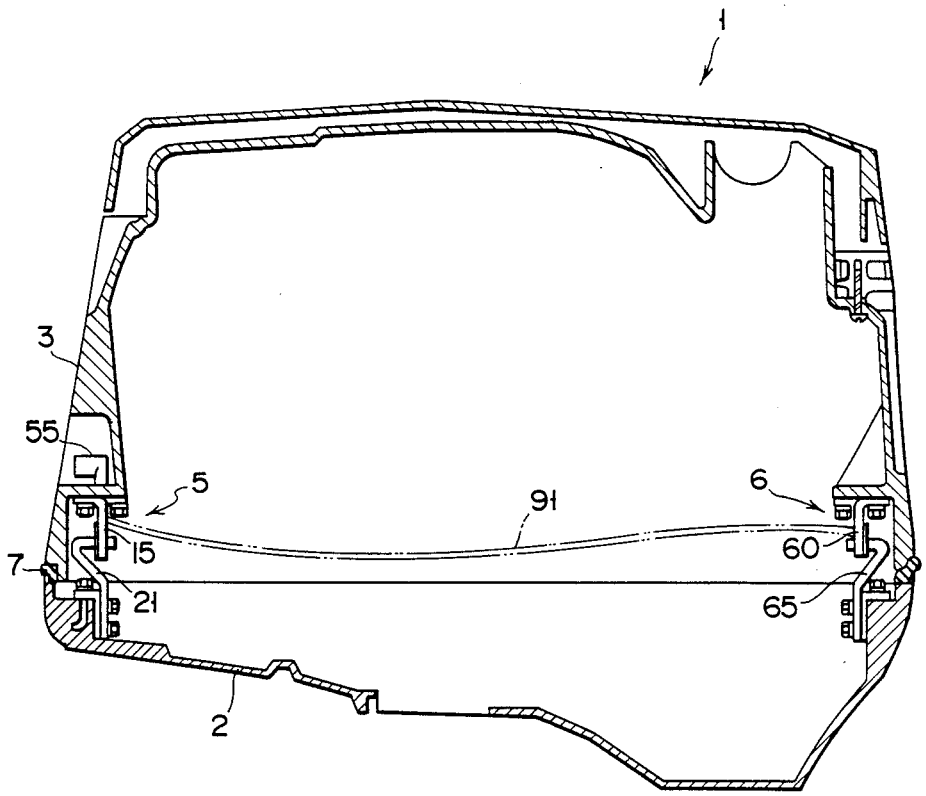
FIG. 14 is a cross-sectional view of a cowling assembly according to a second embodiment of the present invention.

In a second embodiment of the present invention shown in FIG. 14, the locking mechanisms 5 and 6 are arranged in an inverted manner, as compared with the first embodiment. Namely, the top cowling 3 is provided with the base members 15 and 60 and the operation lever 55, and the bottom cowling 2 is provided with the stays 21 and 65. The structures per se of the locking mechanisms 5 and 6 are the same as those described in connection with the first embodiment.

What is claimed is:

1. An apparatus for fixing a top cowling and a bottom cowling to each other, which constitute a cowling assembly of an outboard motor, said apparatus comprising:

a stay secured to one of the top cowling and the bottom cowling;

a base member secured to the other of the top cowling and the bottom cowling and having a receiving section for receiving a portion of the stay;

a locking plate rotatably attached to the base member by means of a first shaft, said locking plate having a stay-receiving face extending in a direction crossing the receiving section, a jaw portion projecting toward the receiving section, a projection, and a spring seat, and said locking plate being rotatable between a locked position, in which the portion of the stay inserted in the receiving section of the base member is clamped between the stay-receiving face and the jaw portion, and a released position in which the jaw portion is retreated from the receiving section to allow the stay to move out of the receiving section;

an intermediate plate rotatably attached to the base member by means of a second shaft, and having a first stopper portion, a second stopper portion, a cam-receiving portion and a spring seat, said first stopper portion being arranged in such a position as to hold the locking plate in the locked position when the first stopper portion is engaged with the projection of the locking plate, and said second stopper portion being arranged in such a position as to hold the locking plate in the released position when the second stopper portion is engaged with the projection of the locking plate;

a cam member rotatably arranged near the intermediate plate, the cam member pushing the cam-receiving portion of the intermediate plate when the cam member is rotated to a predetermined position, thereby rotating the intermediate plate in such a direction as to release the engagement between the projection of the locking plate and the first stopper portion;

an operating lever arranged at a front portion of the cowling assembly, for rotating the cam member; and a spring interposed, in its compressed form, between the spring seat of the locking plate and the spring seat of the intermediate plate, the spring urging the locking plate and the intermediate plate to rotate in such a direction as to engage the projection of the locking plate with the stopper portions of the intermediate plate.

2. The apparatus according to claim 1, wherein said operating lever is arranged at a front portion of the lower surface of the bottom cowling, and the operating lever has a shaft extending in a direction perpendicular to said first and second shafts, said cam member being fixed to the shaft of the operating lever.

3. An apparatus having a front locking mechanism and a rear locking mechanism for fixing a top cowling and a bottom cowling to each other, which constitute a cowling assembly of an outboard motor, wherein said front locking mechanism comprises:

a front stay secured to one of the top cowling and the bottom cowling;

a front base member secured to the other of the top cowling and the bottom cowling and having a receiving section for receiving a portion of the stay;

a front locking plate rotatably attached to the base member by means of a first shaft, said locking plate having a stay-receiving face extending in a direction crossing the receiving section, a jaw portion projecting toward the receiving section, a projection, and a spring seat, and said locking plate being rotatable between a locked position, in which the portion of the stay inserted in the receiving section of the base member is clamped between the stay-receiving face and the jaw portion, and a released position in which the jaw portion is retreated from the receiving section to allow the stay to move out of the receiving section;

a front intermediate plate rotatably attached to the base member by means of a second shaft, and having a first stopper portion, a second stopper portion, a cam-receiving portion and a spring seat, said first stopper portion being arranged in such a position as to hold the locking plate in the locked position when the first stopper portion is engaged with the projection of the locking plate, and said second stopper portion being arranged in such a position as to hold the locking plate in the released position when the second stopper portion is engaged with the projection of the locking plate;

a cam member rotatably arranged near the intermediate plate, the cam member pushing the cam-receiving portion of the intermediate plate when the cam member is rotated to a predetermined position, thereby rotating the intermediate plate in such a direction as to release the engagement between the projection of the locking plate and the first stopper portion;

an operating lever arranged at a front portion of the cowling assembly, for rotating the cam member; and a front spring interposed, in its compressed form, between the spring seat of the locking plate and the spring seat of the intermediate plate, the spring urging the locking plate and the intermediate plate to rotate in such a direction as to engage the projection of the locking plate with the stopper portions of the intermediate plate, and wherein said rear locking mechanism comprises:

a rear stay secured to one of the top cowling and the bottom cowling;

a rear base member secured to the other of the top cowling and the bottom cowling and having a receiving section for receiving a portion of the rear stay;

a rear locking plate rotatably attached to the rear base member by means of a third shaft, said rear locking plate having a stay-receiving face extending in a direction crossing the receiving section, a jaw portion projecting toward the receiving section, a projection, and a spring seat, and said rear locking plate being rotatable between a locked position, in which the portion of the rear stay inserted in the receiving section of the rear base member is clamped between the stay-receiving face and the jaw portion, and a released position in which the jaw portion is retreated from the receiving section to allow the rear stay to move out of the receiving section;

a rear intermediate plate rotatably attached to the rear base member by means of a fourth shaft, and having a third stopper portion, a fourth stopper portion, a cam-receiving portion, a spring seat, and a cable connecting section, said third stopper portion being arranged in such a position as to hold the rear locking plate in the locked position when the third stopper portion is engaged with the projection of the rear locking plate, said fourth stopper portion being arranged in such a position as to hold the rear locking plate in the released position when the fourth stopper portion is engaged with the projection of the rear locking plate;

a rear spring interposed, in its compressed form, between the spring seat of the rear locking plate and the spring seat of the rear intermediate plate, the spring urging the rear locking plate and the rear intermediate plate to rotate in such a direction as to engage the projection of the rear locking plate with the stopper portions of the rear intermediate plate; and a cable having one end connected to a member cooperating with said operating lever, and the other end connected to the cable connecting section of the rear intermediate plate.

4. The apparatus according to claim 3, wherein said cam member of the front locking mechanism is provided with a cable connecting section to which said one end of the cable is connected, and the other end of the cable is connected to said cable connecting section of the rear intermediate plate.

* * * * *